United States Patent [19]

Erickson et al.

[11] 4,036,427

[45] July 19, 1977

[54] COMBINATION PITOT PUMP AND CENTRIFUGAL SEPARATOR

[75] Inventors: John W Erickson, Huntington Beach; Vitolis Budrys, La Mirada; Francis Barton Brown, La Crescenta, all of Calif.

[73] Assignee: Kobe, Inc., Huntington Beach, Calif.

[21] Appl. No.: 584,574

[22] Filed: June 6, 1975

[51] Int. Cl.[2] ..... B04B 1/12; B04B 11/08

[52] U.S. Cl. ..... 233/10; 233/21; 233/32; 233/47 R; 415/89

[58] Field of Search ..... 233/3, 10, 21, 22, 27, 233/28, 29, 32, 34, 38, 39, 46, 47 R, 47 A, 7, 14 R, 14 A, 1 E, 1 B; 415/89

[56] References Cited

U.S. PATENT DOCUMENTS

| | | | |
|---|---|---|---|
| 2,179,941 | 11/1939 | Lindgren | 233/14 A |
| 2,324,933 | 7/1943 | Jones | 233/1 E |
| 2,910,226 | 10/1959 | Thylefors | 233/14 R |
| 3,049,081 | 8/1962 | Singelmann | 415/89 |
| 3,302,873 | 2/1967 | Kowata | 233/14 R |
| 3,348,767 | 10/1967 | Ferney | 233/14 R |
| 3,640,467 | 2/1972 | Moller | 233/46 X |
| 3,764,062 | 10/1973 | Brautigam | 233/7 |
| 3,817,446 | 6/1974 | Erickson | 233/47 R |
| 3,851,818 | 12/1974 | Pause | 233/27 X |
| 3,966,117 | 6/1976 | Johannes | 233/21 X |

*Primary Examiner*—George H. Krizmanich
*Attorney, Agent, or Firm*—Christie, Parker & Hale

[57] ABSTRACT

A combination pitot pump and centrifugal separator for pumping contaminated fluids and for separating contaminants from the pumped fluid includes a rotatable hollow casing. Contaminated fluid is delivered to the interior of the casing and a pumped fluid discharge duct is provided coaxially from the casing. A stationary pitot tube is supported within the casing for collecting, by a ram effect, cleaned fluid from the interior of the casing at a selected location between the casing axis and its outer periphery, and for converting the velocity head of the collected fluid to pressure in the course of supplying the collected fluid to the discharge duct. A plurality of orifices are formed through the outer periphery of the casing for discharging from the casing contaminant matter in fluid introduced into the casing and separated centrifugally therefrom within the casing. Vane means extend into close proximity to the inner surface of the casing at the outer periphery thereof for agitating and, if necessary, dislodging centrifugally separated accumulations of contaminant matter on the casing inner surface and thereby promote movement of the contaminant matter through the orifices. The outer end portion of the vane means may be arranged to direct a jet of relatively clean fluid to the inner surface of the casing.

70 Claims, 10 Drawing Figures

Fig. 9
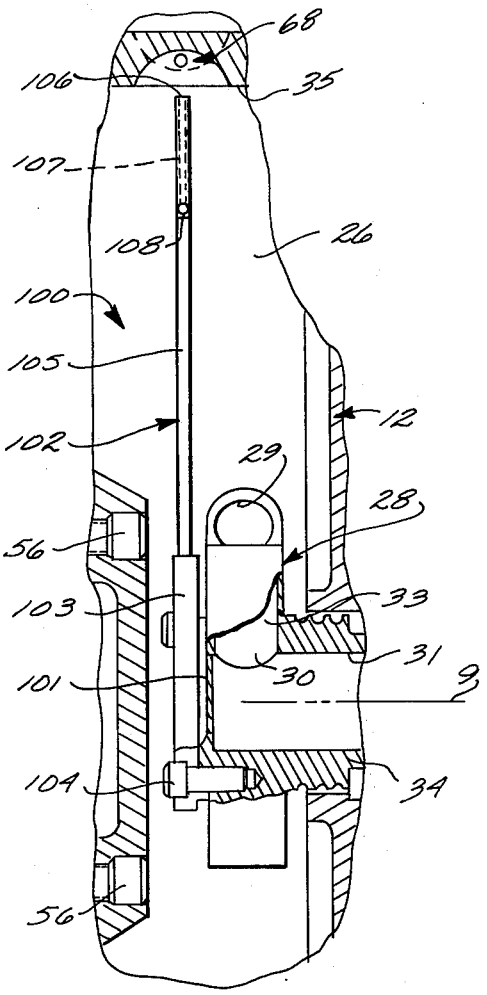
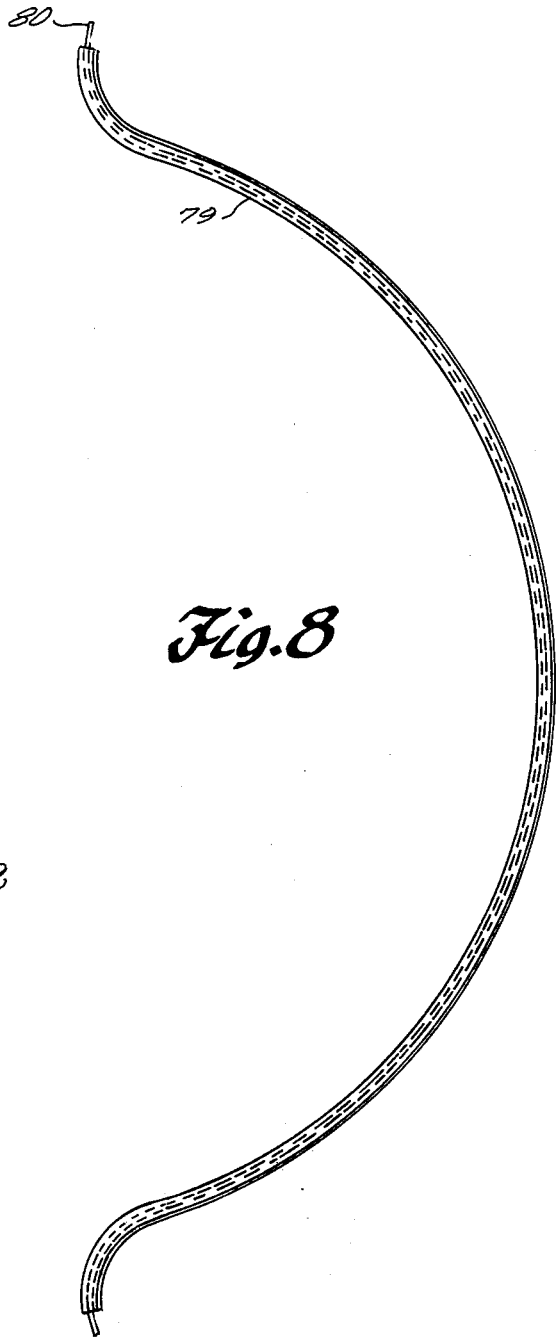
Fig. 8

COMBINATION PITOT PUMP AND CENTRIFUGAL SEPARATOR

BACKGROUND OF THE INVENTION

1. Field of the Invention

This invention pertains to centrifugal separators for fluid. More particularly, it pertains to pitot pumps for separating contaminants, such as viscous liquids or solids, from princiipal fluids and for pumping the cleaned principal fluid.

2. Review of the Prior Art

Pitot pumps are a form of centrifugal pump and typically include a hollow rotatable casing disposed within a surrounding housing, means for delivering a fluid to be pumped to the casing, and a pitot tube fixed in the casing for collecting fluid at a desired point in the casing spaced from its rotational axis with a ram effect. Such pumps also include a discharge system for receiving fluids from the pitot tube and for discharging the same at a desired pressure coaxially of the casing. Such pitot pumps are shown in U.S. Pat. Nos. 3,795,459, 3,817,659 and 3,838,939, all of which are owned by the assignee of this invention.

Pitot pumps are used for many purposes. One use, which illustrates the problems to which this invention is addressed, is to supply motive pressurized liquid to a hydraulic pump located in the bore of an oil well for pumping oil out of the well into a suitable collection facility. In such an application, the motive fluid for the well bore pump may be a portion of the oil produced from the well itself and supplied to the inlet of the pitot pump. Very often, however, the oil taken from the well contains contamnants, notably sand, which should be removed from the oil before it is returned under pressure to the pump located in the well; the presence of said in the pressurized oil supplied to the well bore pump produces undue wear and damage to this pump. It has, therefore, been proposed to construct a pitot pump, to which oil is supplied from the well for pressurization prior to return to the well bore pump, as both a pump and as a centrifugal separator in which sand or other contaminants are removed from the oil as the oil is pressurized, i.e., pumped. See, for example, U.S. Pat. No. 3,817,446 owned by the assignee of this invention.

Experience with the pitot pump-separators of the character shown in U.S. Pat. No. 3,817,446 has shown that sand and other solid or heavy viscous contaminants in the principal fluid tend to accumulate on the inner walls of the rotatable casing adjacent its outer periphery and thereby clog or plug the ducts and jets provided generally radially through the casing outer periphery. These ducts and jets discharge the contaminants from the casing into the housing separately from discharge of the principal fluid from the pump-separator coaxially of the casing. Such clogging of the contaminant discharge ducts and jets is a major one of the several problems to which this invention is successfully addressed; other ones of these problems, and the solutions of the same, are made apparent hereinafter.

SUMMARY OF THE INVENTION

This invention successfully meets the clogging problem outlined above. This problem, as well as other problems, is overcome by the use of techniques and structures which are simple, effective, efficient and reliable, and which are economic in that they are compatible with, and make effective use of elements, arrangements and components of presently available pitot pumps and pitot pump-separators.

In general structural terms, this invention may be summarized as constituting a combination pitot pump and centrifugal separator which includes a rotary casing mounted for rotation in a selected direction about an axis. Means are provided for delivering to the interior of the casing a contaminated fluid to be pumped and cleaned. A pumped fluid discharge duct is defined coaxially with the casing. A pitot tube extends radially of the casing axis in the casing and has, adjacent its outer end, an inlet facing in a direction opposite to the direction of rotation of the casing. The pitot tube has a passage connected to the inlet and extending generally in the direction of casing rotation and also toward the axis to an outlet connected to the discharge duct. Orifice means are carried by the outer periphery of the casing and communicate between the interior and the exterior of the casing for discharging from the casing contaminant matter in fluid introduced into the casing and separated centrifugally therefrom within the casing. The combination pump-separator also includes means operable during pumping and separating operation of the pump and separator for agitating centrifugally separated accumulations of contaminant matter on the casing inner surface along the entire extent of the outer periphery of the casing. Also this invention constitutes a centrifugal separator for separating particulate and sludge contaminants from a liquid carrier medium. The separator includes a rotary casing mounted for rotation about an axis. Means are provided for delivering to the casing a liquid medium containing contaminant material and for conducting from the casing liquid medium from which the contaminant material has been removed. Orifice means are carried by the outer periphery of the casing and communicate between the interior and the exterior of the casing for discharging from the casing contaminant matter in liquid introduced into the casing and separated centrifugally therefrom within the casing. The separator also includes agitating means in the casing mounted for rotation of the casing relatively therepast. The agitating means are disposed in operative association with the orifice means inwardly toward the axis from the path of movement of the orifice means during rotation of the casing. The agitating means are operable during separating operation of the separator for agitating centrifugally separated accummulations of contaminant matter on the inner surface of the casing along the path of the orifice means adequately to prevent substantial clogging of the orifice means by the contaminant matter.

DESCRIPTION OF THE DRAWINGS

The above-mentioned and other features of this invention, and also additional problems solved by this invention, are more fully set forth in the following detailed description of presently preferred embodiments of the invention, which description is presented with reference to the accompanying drawings, wherein:

FIG. 8 is an elevation view of an elastomeric protector member for use in a pump-separator according to this invention, as shown in FIG. 7;

FIG. 9 is a fragmentary cross-sectional elevation view of portions of another pump-separator.

DESCRIPTION OF THE ILLUSTRATED EMBODIMENTS

Figure 1:
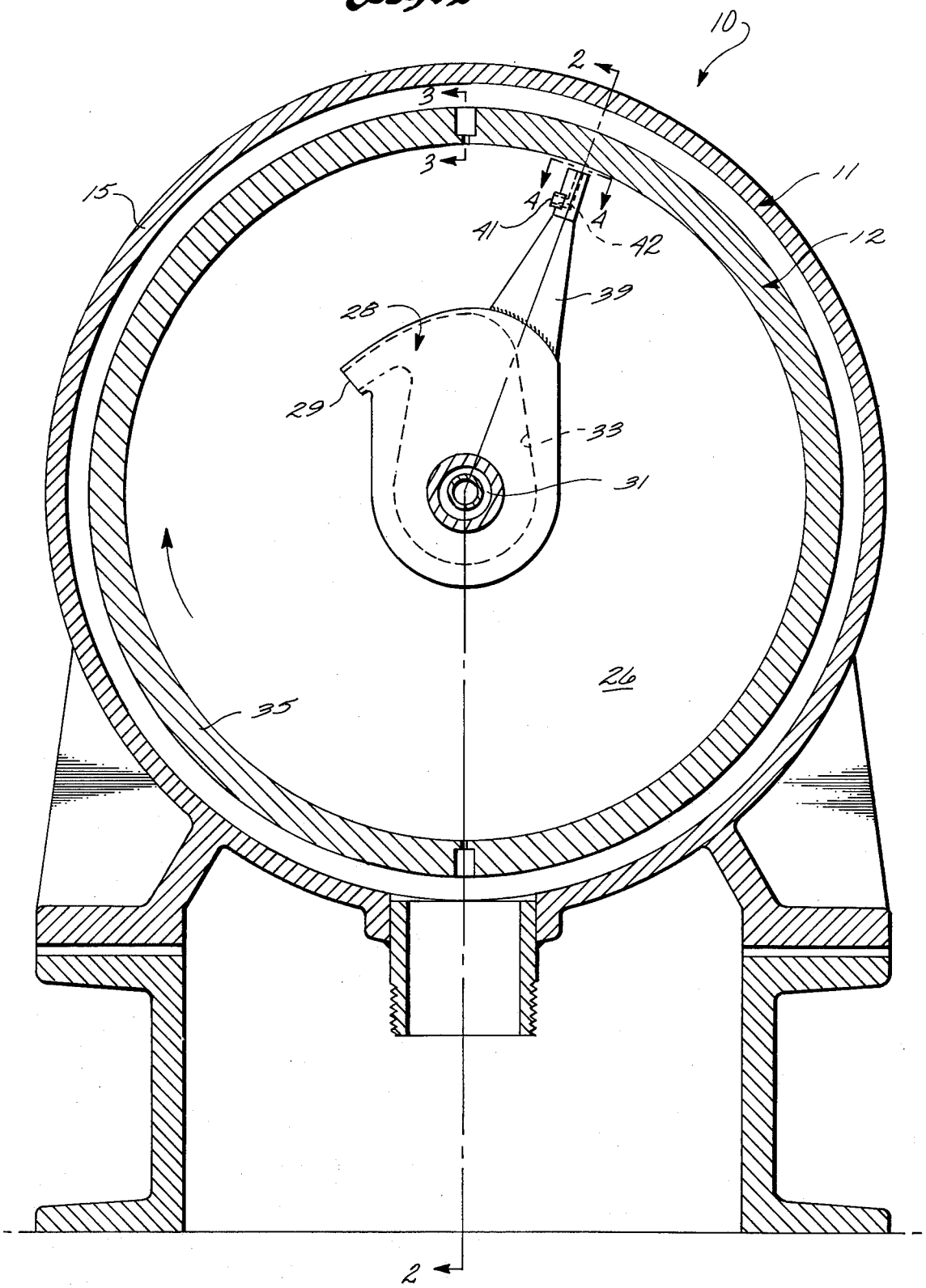
FIG. 1 is a transverse cross-sectional elevation view of a combination pitot pump and centrifugal separator.
Figures 2, 3, 4, 5:
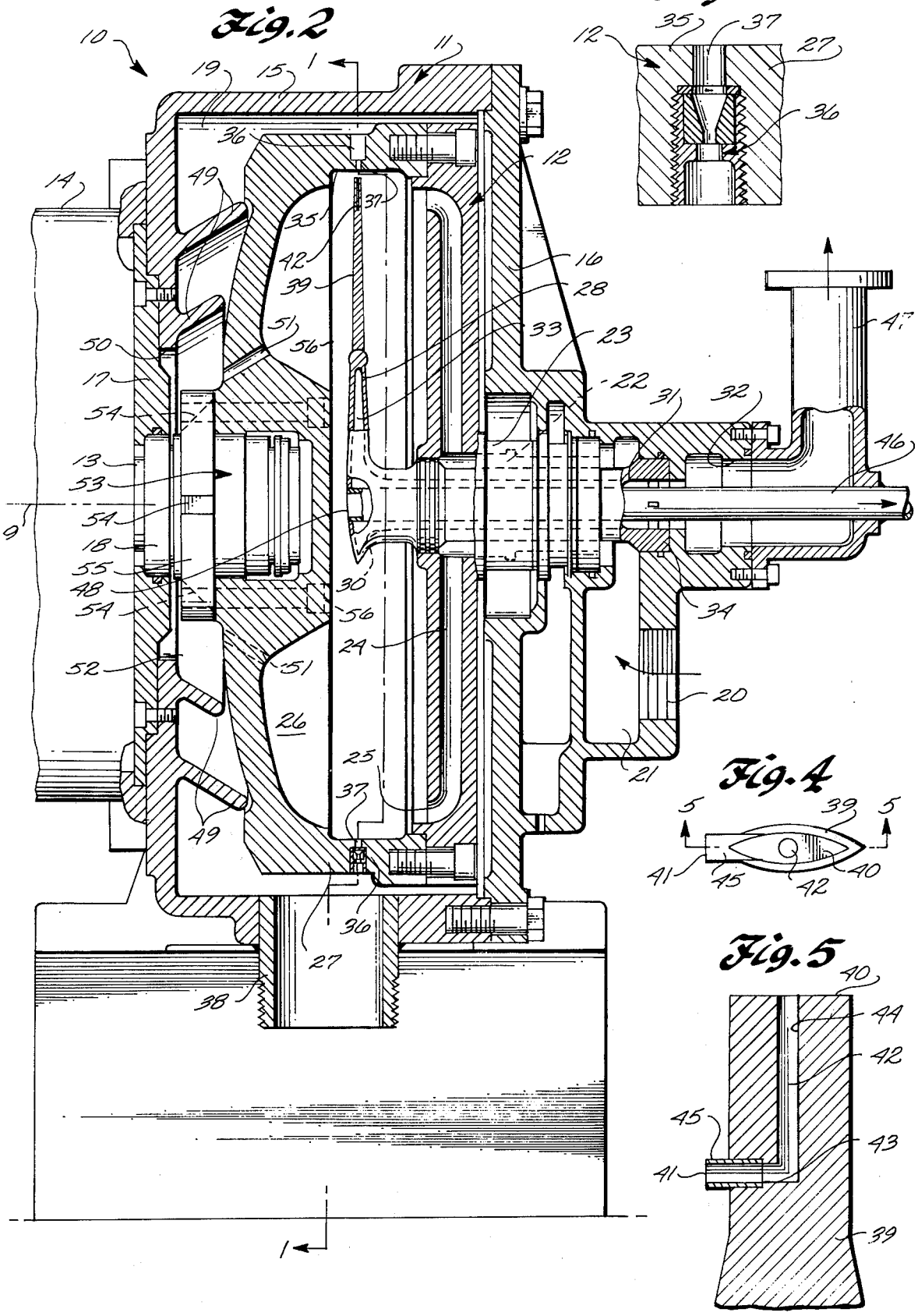
FIG. 2 is a cross-section view taken along line 2—2 in FIG. 1.
FIG. 3 is an enlarged fragmentary cross-section view taken along line 3—3 in FIG. 1.
FIG. 4 is an enlarged view taken along line 4—4 in FIG. 1.
FIG. 5 is a cross-section view taken along line 5—5 in FIG. 4.

A pitot pump-separator 10, shown in FIGS. 1–5 and especially FIG. 2, includes an outer housing 11 and a hollow rotary casing 12, the casing is mounted coaxially to the shaft 13 of an electric motor (not shown), which is connected to the housing via a motor support and bearing assembly 14, for rotation about axis 9 which is also the axis of symmetry of the casing. The housing is composed principally of an annular casting 15 open at one end opposite from the drive motor where it is closed by a cover 16. A smaller cover 17 closes the other end of the casting and mounts a suitable seal 18 which cooperates with the shaft to prevent leakage of fluid from a housing chamber 19 along the drive shaft into the motor and bearing support assembly. Shaft 13 is supported within assembly 14 by suitable bearings (not shown) so that is may carry the rotary casing in a cantilever fashion within the housing chamber.

Housing cover 16 defines an inlet 20 for fluid to be pumped. The inlet opens to a chamber 21 which leads to an annular inlet passage 22 formed coaxially through an axial inlet hub 23 of the rotary casing. A plurality of generally radial ducts 24 are formed within the end wall of the casing adjacent housing cover 16 and open, as at 25, to a generally circular central pumping chamber 26 within the casing. Openings 25 are located relatively closely adjacent to the outer periphery 27 of the casing. Ducts 24 provide fluid flow communication between annular inlet passage 22 and the casing chamber.

Within the pumping chamber is a stationary pitot or pickup tube 28 which is oriented radially of axis 9 and is provided adjacent its outer end with an inlet 29 (FIG. 1) facing in a direction opposite to the direction of rotation of the rotary casing. The pitot tube has an outlet 30 coaxial with axis 9, the outlet communicating with an axial discharge duct 31 leading to an outlet port 32 from the housing. The inlet passage surrounds the discharge duct throughout a portion of the length of the latter which is defined by a bore through an axial hub 34 of the pitot tube. Within the pitot tube, in a manner well known, is a passage 33 which is connected to the pitot inlet and which extends generally in the direction of casing rotation and toward the axis of the pump where it communicates with the pitot outlet 30. The pitot tube hub is supported in housing cover 16 in a stationary manner for rotation of the casing about the pitot tube hub. Thus, fluid to be pumped and pumped fluid enter and leave the pump in a counterflow manner coaxially of the casing at the end of the pump opposite the drive motor.

The general mode of operation of this apparatus as a pitot pump is well known so that it does not need to be described in great detail. Briefly, as casing 12 is rotated at high speed in a predetermined direction (see the arrow in FIG. 1) about its axis, casing ducts 24 collectively function as a centrifugal pump to draw fluid to be pumped and cleaned into inlet 20 and to discharge such fluid at high velocity into the pumping chamber adjacent the outer periphery of the casing. Fluid in the pumping chamber rotates with the casing and enters the inlet of the pitot tube, the pressure of the fluid entering the pitot inlet being increased by a ram effect which converts the velocity head of such fluid into pressure due to the configuration of the pitot passage 33. The pump fluid entering the pitot tube flows through the pitot passage, into the discharge duct, and to the main outlet port 32 from the housing. Heavy solid or viscous constituents (contaminants) in fluid introduced into the pumping chamber are acted upon within the pumping chamber by centrifugal force, and tend to accumulate and concentrate along the inner wall of the casing at its outer periphery.

The pitot tube is arranged so that its inlet is disposed intermediate the casing axis and the outer periphery of the rotary casing, rather than closely adjacent the outer periphery of the casing, so as to collect pumped fluid from which a major portion of the contaminant has been removed. The precise location of the pitot tube inlet radially of the casing is selected with regard to the pressure to be produced by the pump and the amount and extend of contaminant which is tolerable in the pump discharge.

A plurality of contaminant discharge jet orifice nozzle assemblies 36 are mounted in the outer periphery of the rotary casing adjacent the outer ends of suitable contaminant discharge passages 37 (see FIGS. 2 and 3). Preferably the inlet ends of passages 37 are all aligned in a common plane perpendicular to the pump axis; the pitot tube inlet preferably is centered in this plane in pump-separator 10. Jet nozzles 36 and passages 37 provide communication from the interior of the casing to the interior of the housing. During operation of the pump-separator, contaminants accumulated along casing inner wall 35 are continuously discharged through passages 37 and the nozzles into housing chamber 19. Contaminants passed into the housing flow through a contaminant discharge port 38 formed in the lowemost extent of the housing.

A stirrer vane 39 is mounted to the outer end of the pitot tube (as shown best in FIG. 1) and extends radially of the pump axis to an outer end 40 which is spaced closely adjacent to the casing inner surface. The close cooperation between the vane end and the inner surface of the rotary casing generates turbulence in the outermost extent of the pumping chamber, which turbulence agitates and dislodges accumulations of contaminant matter tending to be centrifugally deposited upon the casing inner walls. This agitation and dislodging of contaminants promotes flow of the contaminants through the jet nozzles and counteracts any tendency of the contaminants to merely accumulate on the casing inner surface. In other words, the cooperation of the vane with the casing inner surfaces minimizes the thickness radially of the casing, of any stagnant or low velocity laminar flow boundary layer which may tend to form in the pumping chamber along its outer periphery and from which heavy constituents of the inlet fluid tend to separate and build up on the casing surfaces.

This result in addition to enhancing the contaminant separation and 91 operations, also maintains the dynamic balance of the rapidly rotating rotary casing. Maintenance of the dynamic balance of the rotary casing prevents vibration and prolongs the useful life of the unit, especially the seals and bearings associated with the rotating elements of the unit and its drive motor.

Preferably the clearance between the outer end of the stirrer vane and the inner surface of the casing is on the order of 0.125 inch or so. It is also preferred that the extreme tip end of the stirrer vane be defined of a very hard wear-resistant material, such as tungsten carbide, so that the stirrer vane is not unduly eroded by the contaminant materials, particularly solid contaminant materials, concentrated at the casing inner surface during operation of the pump-separator.

It has been found that when the fluid handled by the pump-separator is a mixture of oil and sand, in which the oil is to be pumped and the sand is to be separated, a simple stirrer vane, even one with a tungsten carbide tip, rapidly erodes at its tip. However, the vane does function to keep the inner surface of the casing clean until the stirrer vane tip has eroded substantially. To prevent such vane erosion, the tip end portion of the stirrer vane includes a pitot-type jet nozzle, which as shown in FIGS. 1 and 5, has an inlet 41 which faces from the stirrer vane in a direction opposite to the direction of rotation of the rotary casing. The jet inlet communicates to a passage 42 which has a first inlet portion 43 extending into the stirrer vane in the direction of casing rotation and a second discharge portion 44 (see FIG. 5) which extends radialy outwardly of the pump axis to communication with the casing inner surface through the vane outer end. The jet inlet preferably is defined by a piece of tungsten carbide 45 having an axial bore which is received in the vane. Inlet 41 is spaced sufficiently inwardly from the casing surface that it receives relatively clean fluid from the pumping chamber, which fluid is discharged at high velocity and pressure from the passage to the casing surface to agitate and dislodge centrifugally deposited accumulations of contaminant matter, especially solid contaminant matter, on the casing inner surface. It has been found that incorporation of jet passage 42 in the outer end portion of stirrer vane 39 substantially entirely eliminates erosion of the stirrer vane and clogging of nozzles 36 during handling of sand-contaminated oil and the like.

As shown particularly in FIG. 4, the stirrer vane, especially at and adjacent its outer end, is streamlined so as to generate minimum turbulence within the pumping chamber inwardly from the extreme outer margins of the chamber. The presence of turbulence within the pumping chamber, except immediately adjacent to casing inner surface 35, adversely affects separation of contaminants from the principal fluid being pumped and causes fluid which enters pitot tube assembly 28 to be less clean than would otherwise be the case. The vane has a much smaller projected area in a plane which includes the casing axis and which passes through the vane than it does in a plane normal to the casing axis; compare FIGS. 2 and 1, respectively.

To better adapt pump-separator 10 for use as a pressurizer for the motive fluid, oil, supplied to a well bore pump, a gas extraction tube 46 is disposed coaxially within the hub of the pitot tube assembly. The gas extraction tube is located within discharge duct 31 so as to extend through discharge port 32, and preferably also through a collection fitting 47 connected to the housing for receiving pumped fluid from the discharge port. The discharge duct 31 from the pitot passage is annular and is defined about the exterior of the gas extraction tube which has an inlet 48 into the pumping chamber through the pitot tube assembly along the pump axis.

It is quite common for gas to be present, either in its free state or in solution, in oil extracted from an oil well, and the presence of such gas in oil introduced to the pump-separator 10 tends to accumulate in the central portion of the pumping chamber. Such accumulated gas enters the gas extraction tube for removal from the pump chamber separately from removal of pumped fluid from the pumping chamber via the pitot tube assembly. The presence of gas extraction tube 46 in pump-separator 10 assures that free gas in the pumping chamber does not accumulate in sufficient quantities to enter the pitot passage with oil from which sand and the like has been separated. It will be understood, however, that if the oil extracted from the oil well of interest contains large quantities of free gas, say, greater than 5% by volume, it may be preferable to extract such gas from the oil in a conventional gas/oil separator before introducing the oil into the pump-separator.

To assure trouble-free operation of pump-separator 10, it is desirable that the fluid presented to the casing side of the seal assembly 18 be as free of sand or other solid contaminants as possible, and that a flow of relatively clean fluid be established across the casing side of the seal assembly to wash away any solid contaminants which may enter the vicinity. Solid contaminants introduced into chamber 19 through jet nozzle assemblies 36 are routed away from the area of the seal assembly, as they moe to contaminant discharge port 38, by a plurality of deflector baffles 49 connected to the inner walls of the housing adjacent to the seal assembly. As shown in FIG. 2, the deflector baffles preferably are formed integral with the inner walls of the housing concentric to the axis 9 circumferentially around the housing opening 50 which is closed by cover 17. Each baffle increases in diameter proceeding into the housing chamber along axis 9. Accordingly, each of the baffles has a configuration of a truncated right cone. The ends of the baffles spaced from the housing wall cooperate closely with the adjacent surfaces of the rotary casing 12. Sand present in the upper portions of the housing chamber 19 falls upon the convex outer surfaces of the baffles and slides along the inclined surfaces of the baffles toward the housing wall and downwardly along the housing wall to the lower portions of the housing chamber, rather than tending to pass through the spaces between the ends of the baffles and the casing into the vicinity of the seal assembly 18.

During operation of the pump-separator 10, the casing side of the seal assembly is bathed by relatively clean pumped fluid applied to the vicinity of the seal assembly by a plurality of circulation passages 51 in the rotary casing. The passages open at their ends opposite from the pumping chamber into the space 52 adjacent the seal assembly which is encircled by the innermost one of the deflector baffles 49. A coupling 53 is screwed to the end of motor shaft 13 within the housing chamber for mounting the rotary casing to the shaft. A notch 54 is cut in a flange 55 of the coupling in alignment with each of the circulation passages so that pumped fluid emerging from the passages into space 52 may be sprayed directly upon the casing side of the seal assembly. Flange 55 is provided on the coupling to receive bolts 56 which connect the casing to the coupling.

Thus, any particles of sand or other contaminant materials which may enter into the immediate vicinity of the inner side of seal assembly 18 are washed away from the seal assembly by virtue of the continuous spray of a small portion or relatively clean fluid taken from the pumping chamber for this purpose.

Figure 6:
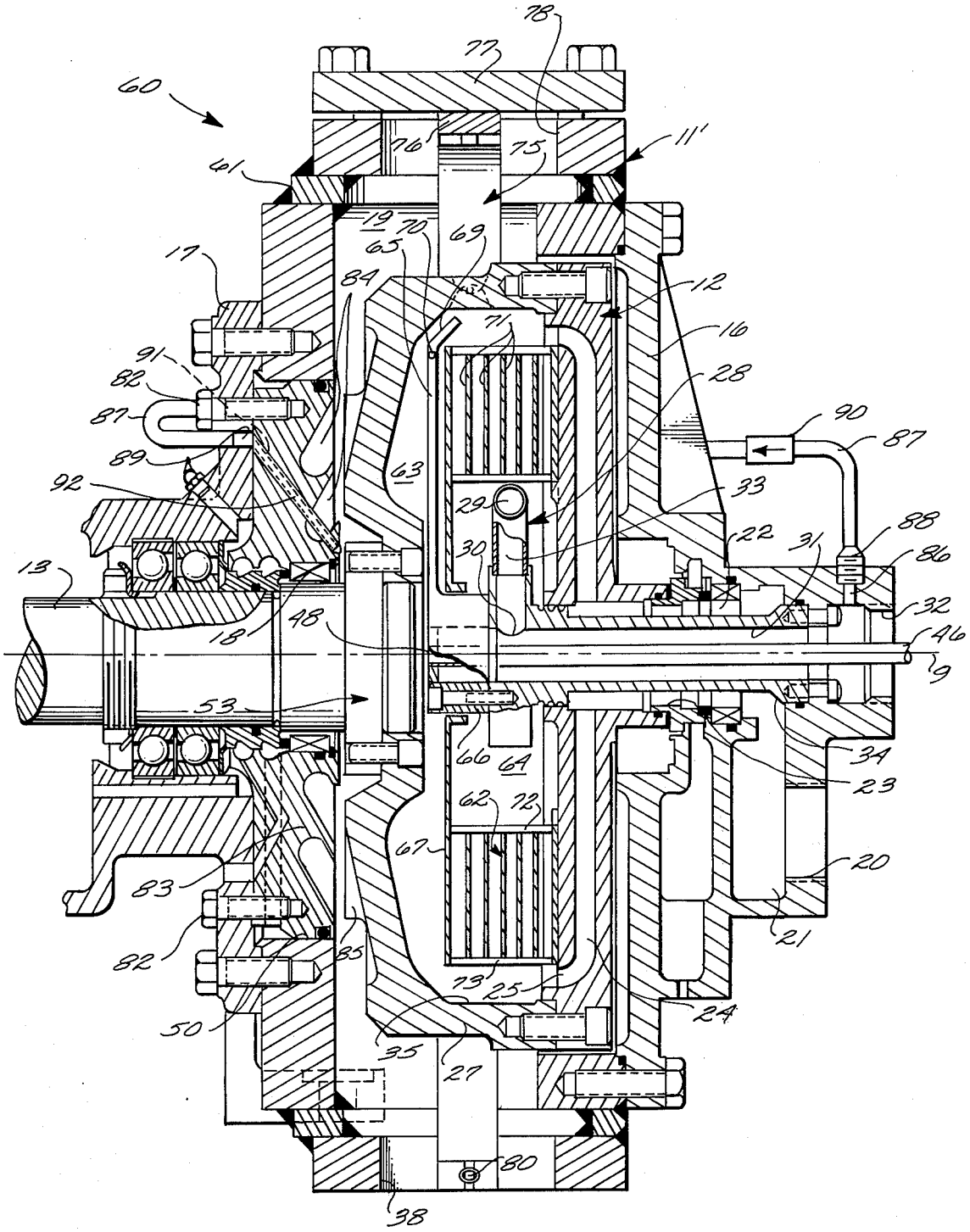
FIG. 6 is a longitudinal vertical cross-sectional view of another pump-separator.
Figure 7:
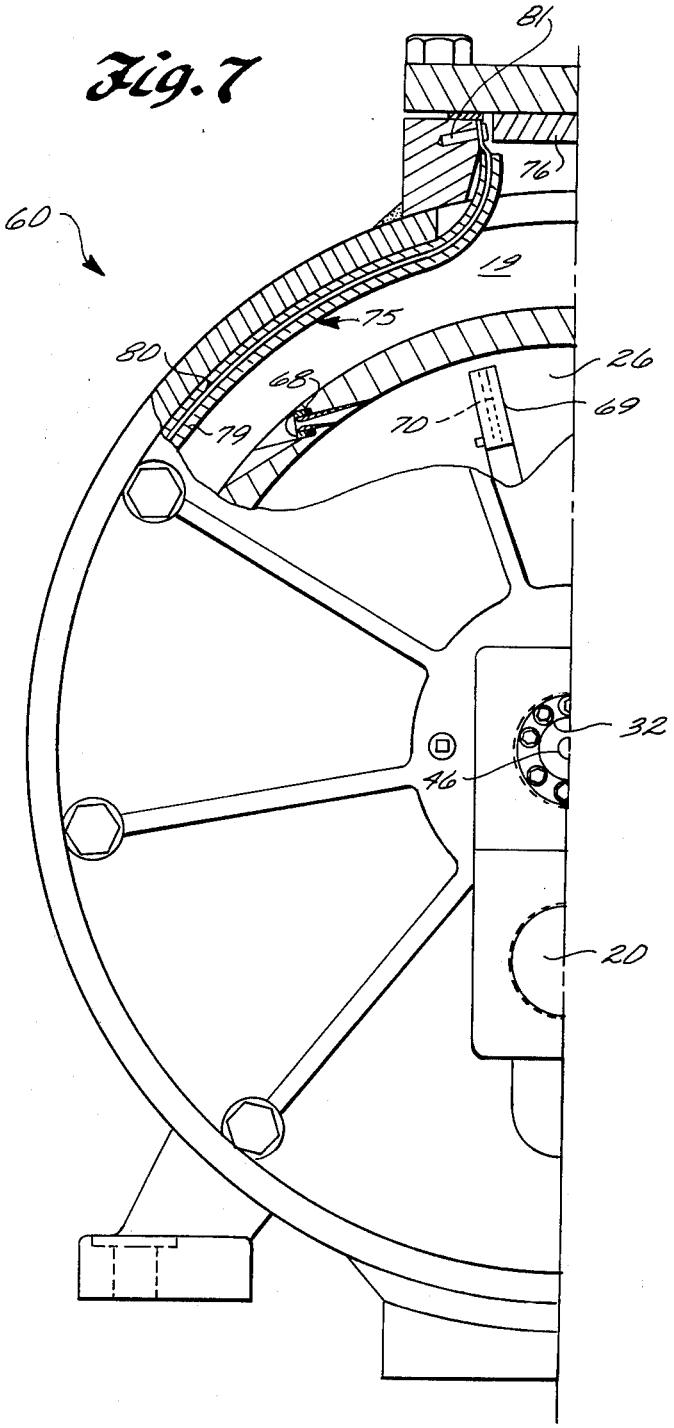
FIG. 7 is a partial end view, with parts broken away and in cross-section, of the pump-separator shown in FIG. 6.

Another pump-separator 60 is shown in FIGS. 6 and 7. To the extent that pump separator 60 includes components or parts identical to or very similar to previously described components of pump-separator 10, the same character numbers as have been used above in the preceding description pertinent to FIGS. 1–5 are also used in FIGS. 6 and 7.

In pump-separator 60, housing 11', the major element of the housing is an annular built-up and welded unit rather than a casting, and the opposite ends of the housing are closed by covers 16 and 17 at the inlet to the pump and around the pump drive shaft 13.

The rotary casing 12 of the pump-separator 60 includes an annular separation-assisting baffle assembly 62 carried by the wall of the casing through which the radial inlet ducts 24 are formed. The annular baffle assembly is disposed concentrically about the axis of the pump-separator. The baffle assembly divides the pumping chamber into an outer pumping chamber 63 and an inner pumping chamber 64 within the annulus of the baffle assembly. The pitot tube assembly 28 is disposed within the inner pumping chamber. A stirrer vane 65 has an axial hub 66 which extends through an axial opening in an end plate 67 of the baffle assembly. The stirrer vane hub is secured to the pitot tube assembly within the inner pumping chamber; the stirrer vane itself is disposed in the outer pumping chamber.

The stirrer vane is disposed principally perpendicular to the axis 9 in a plane spaced parallel to the plane in which are disposed a plurality of contaminant jet nozzle assemblies 68 (see FIG. 7) in the casing outer periphery. An outer end portion 69 of the stirrer vane is oblique (FIG. 6) to the axis so that the outlet portion of a pitot jet passage 70 in the outer end portion of the vane directs a jet of relatively clean pumped fluid against the inner surfaces 35 of the rotary casing generally in the plane of the contaminant jet nozzle assemblies 68.

The contaminant jet nozzle assemblies preferably are of the type described and illustrated in U.S. Pat. No. 3,817,446, see especially FIGS. 2, 3 and 4 thereof, and are arranged approximately tangentially n the rotary casing so that the reaction on the rotary casing of the discharge therefrom is in a direction-assisting rotation of the rotary chamber casing about axis 9.

Jet passage 70 (see FIG. 7) is formed in the outer end portion of stirrer vane 65 so that pump-separator 60 includes a pitot-type jet assembly, similar to that illustrated in FIGS. 4 and 5 in the context of pump-separator 10, for creating turbulence in the outer pumping chamber essentially only along the outer periphery of the rotary casing. As noted above, such turbulence minimizes the existence of a stagnant or low velocity boundary layer of contaminant-rich fluid along the outer walls of the pumping chamber; centrifugally separated contaminants in the outer pumping chamber tend not to accumulate and build up at the outer margin of the pumping chamber. The stream of relatively clean pumped fluid discharged at high velocity from the outer end of the stirrer vane also bathes the inlets to the jet nozzle assemblies 68 as they periodically pass by the outer end of the stationary vane, thereby serving to prevent clogging of the jet nozzle assemblies.

A gas extraction duct 46 has its inlet 48 formed through stirrer vane hub 66, and extends coaxially within the discharge duct 31 and through the discharge port.

As noted above, separation assisting baffle assembly 62 is disposed within the interior of the rotary casing circumferentially of pitot tube assembly 28 to minimize turbulence within the inner pumping chamber 64 which includes the annulus within the baffle assembly and the spaces between a plurality of annular flat radially-disposed baffle disks 71. The baffle disks are spaced along the axis 9 and are held between inner and outer carriers 72 and 73 arranged to provide minimum resistance to flow of fluid from the outer pumping chamber to the central portion of the inner pumping chamber; carriers 72 and 73 conveniently may take the form of cylinders of perforated metal secured at their opposite ends to the baffle assembly end plate 67 and to the radially ducted end wall of the rotary casing. As apparent from FIG. 6, the outer circumferential margin of inner pumping chamber 64 is subdivided into a plurality of layers each of which is radially disposed, the adjacent layers being separated by corresponding ones of the baffle disks. Any turbulence generated in any one of these layers is confined to that layer itself, and such turbulence is also minimized. The result is that the fluid flow from the outer pumping chamber into the central portion of the inner pumping chamber tends to be laminar flow. The avoidance of turbulence in the outer margin of the inner pumping chamber reduces the tendency of fluid flowing from the outer pumping chamber into the inner pumping chamber to carry with it contaminants, such as sand or the like, introduced into the outer pumping chamber through openings 25 and separated from the inlet fluid by centrifugal action in the outer pumping chamber and in the outermost extents of the layers between the baffle disks. The minimization of turbulent flow in the outer portions of the inner pumping chamber, for any given set of operating conditions of the pump-separator, has a direct effect upon the size of sand particles which can effectively be separated from fluid introduced into the rotary casing. Small particles of sand are more prone than large particles to being carried into the vicinity of the pitot tube inlet 29 by fluid flowing from the outer to the inner pumping chambers. The elimination of turbulence directly enhances the ability of the pump-separator to separate small particles of sand from the raw fluid supplied to the inlet port 20. In an exemplary pump-separator, five baffle disks are provided spaced apart 0.375 inch, and have a radial extend between the inner and outer peripheries of about 3 inches.

A pitot pump-separator of the type contemplated by this invention may include a rotary casing 18 inches in diameter driven at 3600 rpm, for example. In such circumstances, it is apparent that the streams of oil and sand, for example, which emerge from jet nozzles 68 into the housing chamber 19 have considerable velocity. An examination of FIG. 7, for example, will show that these streams will tend to erode the inner walls of the housing in the plane of the jet nozzle assemblies. In pump-separator 60, such erosion of the walls of the housing is prevented by the presence of a liner 75 of elastomeric material, such as DuPont Adiprane L-83 rubber having a Shore hardness of 80. The liner is disposed on the surfaces of the housing chamber at locations so related to the positions of jet nozzles 68 to receive at least a principal portion of the material discharged into the housing by the jet nozzles. As shown in FIG. 7, liner 75 includes a strip 76 of rubber, bonded to the underside of a closure 77 to an access port 78 provided into the housing at the upper extent thereof, so as to be in the plane of the jet nozzle assemblies when the closure is secured to the housing, as shown in FIG. 6. Liner 75 is further provided by a pair of identical wall liner strips 79 which are composed of lengths of rubber in which a core 80 of strip steel is embedded to project beyond the opposite ends of the rubber. The exposed ends of the cores serve as lugs by which the stips 79 may be screwed, as 81 (see FIG. 7), into the housing at the access and contaminant discharge ports (see FIG. 6). It is preferred that liner strips 79 be removably secured in the housing as by screws 81, rather than being bonded permanently to the interior of the housing, so that the liner strips may be replaced from time to time as they become worn.

As illustrated in FIG. 6, housing cover 17 of pump-separator 60 has connected thereto by bolts 82 a seal carrier disk 83 which is a component of the housing and which is axially bored to receive shaft seal assembly 18 for the purposes described above. It was noted in the description of pump-separator 10 that it is desirable to prevent, to the greatest extent possible, sand or other contaminants present in housing chamber 19 from entering into the vicinity of seal assembly 18.

In pump-separator 60, the function of the deflector baffles 49 in pump-separator 10 is performed by a series of circular deflector grooves 84 formed in the face of seal carrier disk 83 which opposes the rotary casing. The deflector grooves are formed concentric to the pump-separator axis 9 and are defined so that, proceeding away from their bottoms, they slope upwardly and outwardly from the axis to open toward the outer periphery of the housing chamber 19. A series of fins 84 are carried by the adjacent face of the rotary casing and cooperate with the deflector grooves. This cooperation causes any sand or the like which may move from the upper extent of the housing chamber to between the rotary casing and the housing toward seal assembly 18 to be urged into deflector grooves 84. Such sand falls to the bottom of the grooves, then along the grooves around the seal assembly, and then outwardly from the grooves below the drive shaft 13 in the vicinity of the contaminant discharge port 38.

In pump-separator 60, the inner face of seal assembly 18 is washed by a stream of relatively clean pumped fluid, but by virtue of a mechanism which differs from the mechanism described above as to pump-separator 10. In pump-separator 60, a portion of the pumped fluid which is collected from the inner pumping chamber 64 by the pitot tube assembly 28 is used for this purpose. A port 86 is formed radially through the hub of housing cover 16 upstream of discharge port 32. A length of tubing 87 is connected to the port, as by fitting 88, and extends around the exterior of the housing to be coupled to a port 89 through the other housing cover 17 above drive shaft 13. A check valve 90 is included in the tubing to assure that fluid flows only from discharge duct 31 to port 89. A passage 91 is defined through the seal carrier disk 83 from the port 89 to the housing chamber 19 at a location just above the drive shaft adjacent the inner extent of the seal assembly, as shown in FIG. 6. Preferably passage 91 is defined by a tube 92 snugly received in a suitable hole drilled through the seal carrier disk. The tube defines a jet nozzle at its outlet end. Accordingly, during operation of the pump-separator 60, a stream of clean pumped fluid is continuously sprayed into the vicinity of the inner face of the seal assembly 18 above the drive shaft for establishing and maintaining a flow pattern which carries away from the seal assembly any particles of sand which may enter the area.

A portion of another pump-separator 100, which does not include a gas extraction duct as do pump-separators 10 and 60, is shown in FIG. 9. The discharge duct 31, at its end near the outlet 30 from the pitot passage 33, is completely closed as at 101. A stirrer vane assembly 102 has its hub 103 secured to the pitot tube assembly 28 within pumping chamber 26 as by machine screws 104. A stirrer vane 105 extends radially of the pump-separator axis 9 in a plane perpendicular to the axis to an outer end 106 which is spaced closely adjacent to but inwardly from the casing inner peripheral surface 35 substantially in the same plane in which are located in the outer periphery of the casing a plurality of contaminant jet assemblie 68. A jet passage 107 is defined radially in the outer end portion of the stirrer vane between an outlet in the vane end and an inlet 108 located more inwardly toward the pump-separator axis and facing in a direction opposite to the direction of rotation of the rotary casing. Jet passage 107 functions in the same manner as jet passage 42 shown in FIG. 4, for example, and described above.

Stirrer vane assembly 102 is adapted for mounting to the structure of an existing pitot pump-separator of the type shown in U.S. Pat. No. 3,817,446, for example, to provide the same contaminant agitating benefits as are provided in pump-separator 10, for example.

When only a stirrer vane without a pitot jet passage provided in its outer end is incorporated in a pump-separator according to this invention, the clearance between the outer end of the stirrer vane and the adjacent walls of the rotary casing should be of the nature mentioned above, i.e., about 0.125 inch. On the other hand, where the stirrer vane incorporates a jet passage such as passage 42, the clearance between the end of the stirrer vane and the adjacent face of the rotary casing may be reduced to as little as 0.050 inch. Preferably the outlet opening of a stirrer vane jet passage has a diameter in the range of from about 0.045 to about 0.150 inch.

Figure 10:
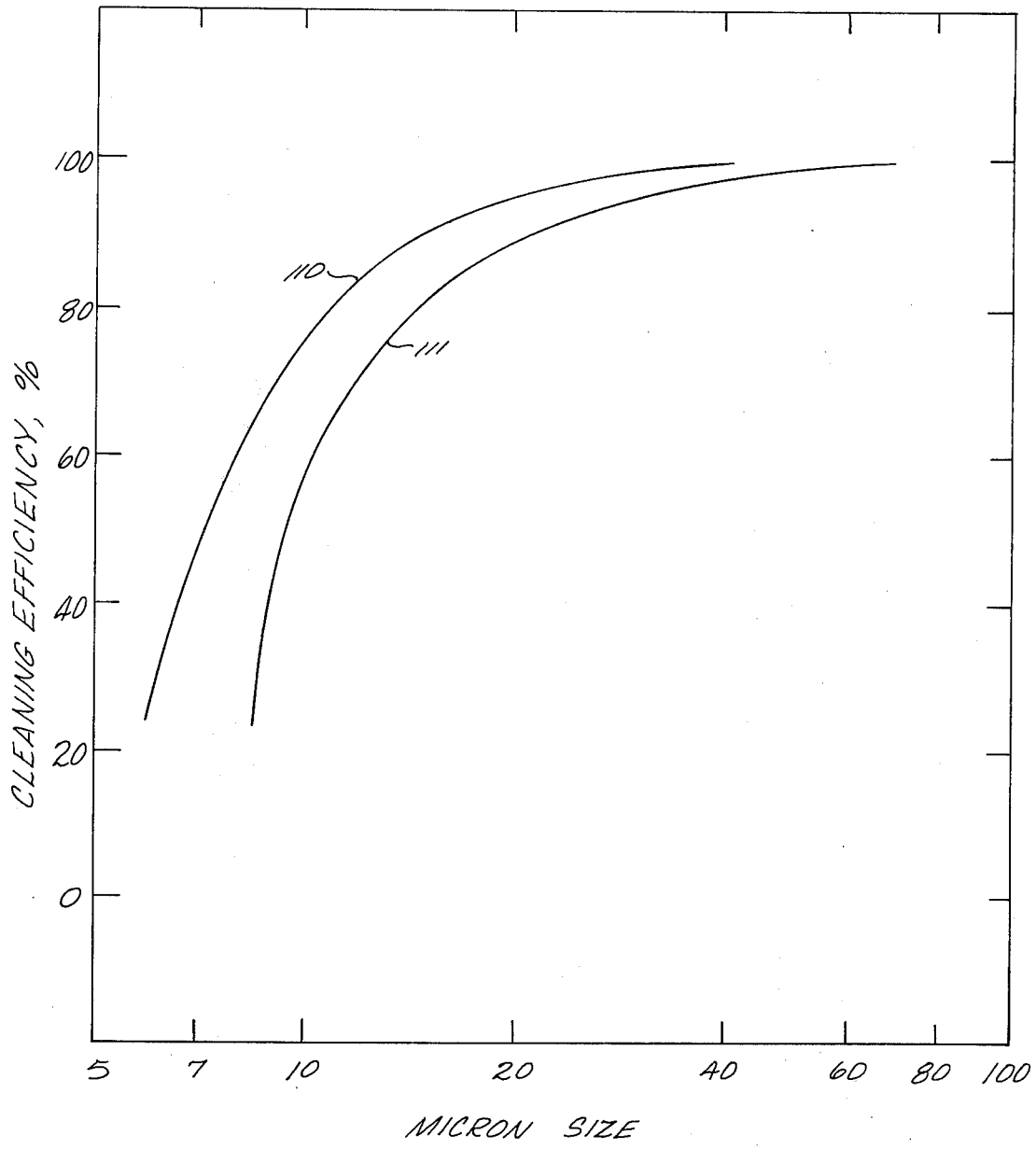
FIG. 10 is a graph on semi-logarithmic coordinates of cleaning efficiency relative to the micron size of solid contaminants in fluid supplied to an exemplary pump-separator operated at different flow rates.

FIG. 10 is a graphical representation of the effect in a pump-separator according to this invention of total fluid flow rate on cleaning efficiency in terms of the percentage of sand particles of a given size removed from the inlet fluid when the pump-separator is operated at constant rpm. FIG. 10 pertains to a pump-separator operated at 3600 rpm, in which the contaminant discharge nozzles from the pumping chamber to the housing chamber are defined radially of the pump-separator axis (as is the case with the jet nozzle assemblies 36 of pump-separator 10) and have a minimum flow diameter of 0.043 inch, and in which the contaminant is predominately about 30 micron sand. Curve 110 of FIG. 10 describes the cleaning efficiency of this pump-separator when the flow rate through the pump-separator is 40 gallons per minute, and curve 111 describes the operation of the same unit when the flow rate is 100 gallons per minute. An examination of curves 110 and 111 shows that the cleaning efficiency of the pump-separator increases with decreasing rate of flow of inlet fluid to the unit. For example, where the inlet fluid flow rate is 100 gallons per minute, 58% of the sand particles having a size of 10 microns are removed from the inlet fluid, whereas when the same pump-separator is operated at a flow rate of 40 gallons per minute, approximately 77% of the 10 micron sand particles are removed from the inlet fluid.

The term "contaminant" has been used in the preceding description, and also in the following claims, to refer to heavy constituents of fluid delivered to the pumping chamber within the rotary casing and separated from the delivered fluid by cemtrifugal action within the pumping chamber in response to rotation of the casing; the heavy constituents may be solid or they may be fluids. The term "contaminant" has been used above because, in the exemplary and presently preferred utility of the pump-separator, sand is a contaminant in the principal fluid, oil, and is to be removed as an undesired constituent not of interest. In some uses of these pump-separators, the constituent centrifugally removed from the fluid delivered to the pumping chamber, rather than its carrier fluid, may be the constituent of principal interest. Therefore, the term "contaminant" as used above should not be regarded as meaning that the solid or rather heavy constituents centrifugally removed in the casing from the fluid therein and discharged from the casing by the peripheral orifices (e.g., jet nozzles 36) may not be useful or have value in their own right.

Workers skilled in the art to which this invention pertains will appreciate that the foregoing description has been presented principally by way of illustration and example with reference to presently preferred embodiments of the invention. Such persons will also appreciate that modifications may be made in the structures and procedures described without departing from the scope of this invention. Accordingly, the foregoing description should not be considered as limiting the scope of the invention as set forth in the following claims.

What is claimed is:

1. A combination pitot pump and centrifugal separator, including:

a. a rotary casing mounted for rotation in a selected direction about an axis;

b. means for delivering to the interior of the casing a contaminated fluid to be pumped and cleaned;

c. a pumped fluid discharge duct coaxial with the casing;

d. a pitot tube extending radially of said axis in the rotary casing and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct;

e. orifice means carried by the outer periphery of the rotary casing and communicating between the interior and the exterior thereof for discharging from the casing contaminant matter in fluid introduced into the casing and separated centrifugally therefrom within the casing; and f. means operable during pumping and separating operation of the pump and separator for agitating centrifugally separated accumulations of contaminant matter on the inner surface of the casing along the entire extent of the outer periphery thereof.

2. Apparatus according to claim 1 wherein the agitating means comprises a vane mounted in the casing and extending to an agitating end spaced proximate to the inner surface of the casing substantially radially inwardly of the path along which the orifice means move during rotation of the casing.

3. Apparatus according to claim 2 wherein the vane is stationary in the casing and extends generally radially of the casing axis.

4. Apparatus according to claim 2 wherein the vane has a substantially smaller projected area in a plane including the casing axis and passing through the vane than it does in a plane normal to the casing axis.

5. Apparatus according to claim 4 wherein the vane has a terminal portion adjacent the agitating end thereof which is streamlined relative to the flow of fluid therepast in the direction of rotation of the casing.

6. Apparatus according to claim 2 wherein the vane, at least at and adjacent the agitating end thereof, is defined by an erosion resistant material.

7. Apparatus according to claim 6 wherein the erosion resistant material is tungsten carbide.

8. Apparatus according to claim 2 wherein the vane is mounted to the pitot tube at a location in the casing spaced from the casing axis and is disposed in a plane normal to the casing axis common to the pitot tube.

9. Apparatus according to claim 2 wherein the vane is mounted to the pitot tube adjacent the casing axis and extends generally parallel to the pitot tube toward the outer periphery of the rotary casing.

10. Apparatus according to claim 1 wherein the agitating means comprises jet means for directing a stream of fluid to the inner surfaces of the casing at the outer periphery thereof in the vicinity of the orifice means.

11. A combination pitot pump and centrifugal separator, including:

a. a rotary casing mounted for rotation in a selected direction about an axis;

b. means for delivering to the interior of the casing a contaminated fluid to be pumped and cleaned;

c. a pumped fluid discharge duct coaxial with the casing;

d. a pitot tube extending radially of said axis in the rotary casing and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct;

e. orifice means carried by the outer periphery of the rotary casing and communicating between the interior and the exterior thereof for discharging from the casing contaminant matter in fluid introduced into the casing and separated centrifugally therefrom within the casing;

f. means for agitating centrifugally separated accumulations of contaminant matter on the inner surface of the casing at the outer periphery thereof, the agitating means comprising a vane mounted in the casing and extending to an agitating end spaced proximate to the inner surface of the casing in the vicinity of the path along which the orifice means move during rotation of the casing; and g. annular separation enhancing baffle means in the casing, the pitot tube being disposed within the annulus of the baffle means.

12. Apparatus according to claim 11 wherein the baffle means divides the interior of the casing into an inner pumping chamber within the baffle means and its annulus and into an outer pumping chamber to which contaminated fluid to be pumped and cleaned is delivered, and the vane is disposed in the outer pumping chamber.

13. Apparatus according to claim 12 wherein the baffle means are carried by the casing for rotation therewith.

14. Apparatus according to claim 13 wherein the baffle means comprises a plurality of annular disks disposed normal to the casing axis and spaced along the axis.

15. A combination pitot pump and centrifugal separator, including:

a. a rotary casing mounted for rotation in a selected direction about an axis;

b. means for delivering to the interior of the casing a contaminated fluid to be pumped and cleaned;

c. a pumped fluid discharge duct coaxial with the casing;

d. a pitot tube extending radially of said axis in the rotary casing and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct;

e. orifice means carried by the outer periphery of the rotary casing and communicating between the interior and the exterior thereof for discharging from the casing contaminant matter in fluid introduced into the casing and separated centrifugally therefrom within the casing; and f. means for agitating centrifugally separated accumulations of contaminant matter on the inner surface of the casing at the outer periphery thereof, the agitating means comprising jet means for directing a stream of fluid to the inner surfaces of the casing at the outer periphery thereof in the vicinity of the orifice means, the jet means including jet passage means having an outlet in the interior of the casing directed toward the casing inner surface in said vicinity and having an inlet spaced nearer the casing axis than the outlet is and opening in a direction opposite to the direction of rotation of the casing.

16. Apparatus according to claim 15 including a vane mounted in the casing and extending to an end spaced proximate to the inner surface of the casing in the vicinity of the orifice means, and wherein the jet passage means is defined in the vane so that the jet passage means outlet opens from the end of the vane.

17. Apparatus according to claim 16 wherein the vane is stationary in the casing and extends generally radially of the casing axis.

18. Apparatus according to claim 16 wherein the vane has a substantially smaller projected area in a plane including the casing axis and passing through the vane than it does in a plane normal to the casing axis.

19. Apparatus according to claim 18 wherein the vane has a terminal portion adjacent the agitating end thereof which is streamlined relative to the flow of fluid therepast in the direction of rotation of the casing.

20. Apparatus according to claim 16 wherein the vane, at least at and adjacent the agitating end thereof, is defined by an erosion resistant material.

21. Apparatus according to claim 20 wherein the erosion resistant material is tungsten carbide.

22. Apparatus according to claim 16 wherein the inlet of the jet passage means is located further outwardly from the casing axis than the pitot tube inlet.

23. Apparatus according to claim 16 wherein the vane is mounted to the pitot tube at a location in the casing spaced from the casing axis and is disposed in a plane normal to the casing common to the pitot tube.

24. Apparatus according to claim 16 wherein the vane is mounted to the pitot tube adjacent the casing axis and extends generally parallel to the pitot tube toward the outer periphery of the rotary casing.

25. Apparatus according to claim 16 including annular separation enhancing baffle means in the casing, and wherein the pitot tube is disposed within the annulus of the baffle means.

26. A combination pitot pump and centrifugal separator, including:

a. a rotary casing mounted for rotation in a selected direction about an axis;

b. means for delivering to the interior of the casing a contaminated fluid to be pumped and cleaned;

c. a pumped fluid discharge duct coaxial with the casing;

d. a pitot tube extending radially of said axis in the rotary casing and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct;

e. orifice means carried by the outer periphery of the rotary casing and communicating between the interior and the exterior thereof for discharging from the casing contaminant matter in fluid introduced into the casing and separated centrifugally therefrom within the casing;

f. means for agitating centrifugally separated accumulations of contaminant matter on the inner surface of the casing at the outer periphery thereof; and g. annular separation enhancing baffle means in the casing, the pitot tube being disposed within the annulus of the baffle means, the baffle means dividing the interior of the casing into an inner pumping chamber within the baffle means and its annulus and into an outer pumping chamber to which contaminated fluid to be pumped and cleaned is delivered.

27. Apparatus according to claim 26 wherein the baffle means are carried by the casing for rotation therewith.

28. Apparatus according to claim 27 wherein the baffle means comprises a plurality of annular disks disposed normal to the casing axis and spaced along the axis.

29. A combination pitot pump and centrifugal separator, including:

a. a housing defining a chamber therein;

b. a rotary casing in the chamber mounted for rotation in a selected direction about an axis;

c. means for delivering to the interior of the casing a contaminated fluid to be pumped and cleaned;

d. a pumped fluid discharge duct coaxial with the casing;

e. a rotatable shaft extending into the housing chamber along said axis and mounting the rotary casing thereon at an end of the casing opposite from the pumped fluid discharge duct;

f. seal means cooperating between the housing and the shaft adjacent the casing for sealing against flow of fluid along the shaft from the housing chamber;

g. a pitot tube extending radially of said axis in the rotary casing and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct;

h. orifice means carried by the outer periphery of the rotary casing and communicating between the interior and the exterior thereof for discharging from the casing contaminant matter in fluid introduced into the casing and separated centrifugally therefrom within the casing;

i. means for agitating centrifugally separated accumulations of contaminant matter on the inner surface of the casing at the outer periphery thereof; and j. contaminant deflector means carried by the housing adjacent the seal means for deflecting from the vicinity of the seal means contaminant matter delivered to the housing chamber by the orifice means.

30. Apparatus according to claim 20 wherein the deflector means comprises at least one fin-like baffle member extending from the housing into the housing chamber along an arc substantially about the shaft axis adjacent to and radially outwardly of the seal means at least above the seal means, the baffle member having a surface facing away from the shaft axis which slopes away from the shaft axis proceeding into the housing chamber from the housing.

31. Apparatus according to claim 30 wherein said arc extends circumferentially around the seal means.

32. Apparatus according to claim 29 wherein the deflector means comprises at least one groove defined in the housing along an arc substantially about the shaft axis adjacent to and radially outwardly of the seal means at least above the seal means, the groove opening to the housing chamber and having wall surfaces which face away from the shaft axis proceeding along the groove from the bottom thereof to the housing chamber.

33. Apparatus according to claim 32 wherein the deflector means comprises deflector fin means carried by the rotary casing adjacent the opening of the deflector groove to the housing chamber.

34. Apparatus according to claim 32 wherein the arc of said groove extends circumferentially around the seal means.

35. A combination pitot pump and centrifugal separator, including:

a. a housing defining a chamber therein;

b. a rotary casing in the chamber mounted for rotation in a selected direction about an axis;

c. means for delivering to the interior of the casing a contaminated fluid to be pumped and cleaned;

d. a pumped fluid discharge duct coaxial with the casing;

e. a rotatable shaft extending into the housing chamber along said axis and mounting the rotary casing thereon at an end of the casing opposite from the pumped fluid discharge duct;

f. seal means cooperating between the housing and the shaft adjacent the casing for sealing against flow of fluid along the shaft from the housing chamber;

g. a pitot tube extending radially of said axis in the rotary casing and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct;

h. orifice means carried by the outer periphery of the rotary casing and communicating between the interior and the exterior thereof for discharging from the casing contaminant matter in fluid introduced into the casing and separated centrifugally therefrom within the casing;

i. means for agitating centrifugally separated accumulations of contaminant matter on the inner surface of the casing at the outer periphery thereof; and j. circulation means for directing a stream of fluid past the seal means for removing from the vicinity of the seal means contaminant matter delivered to the housing chamber by the orifice means.

36. Apparatus according to claim 35 wherein the circulation means comprises at least one circulation passage formed through the rotary casing from an inlet opening to the interior of the casing to an outlet opening to the housing chamber adjacent the seal means, the circulation passage opening to the interior of the casing at a location spaced from the axis for receiving fluid from the casing which is relatively clean of contaminant matter as compared to fluid delivered to the interior of the casing.

37. Apparatus according to claim 35 wherein the circulation means comprises a circulation passage through the housing opening to the housing chamber proximate to and above the shaft adjacent the seal means, and duct means for supplying to the circulation passage a portion of the pumped fluid from said discharge duct.

38. A combination pitot pump and centrifugal separator, including:

a. a housing having a chamber therein;

b. a rotatable shaft extending into the housing chamber;

c. a rotary casing mounted to the shaft in the housing chamber for rotation in a selected direction about an axis;

d. means for delivering to the interior of the casing a contaminated fluid to be pumped and cleaned;

e. a pumped fluid discharge duct coaxial with the casing;

f. a pitot tube extending radially of said axis in the rotary casing and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct;

g. orifice means carried by the outer periphery of the rotary casing and communicating between the interiors of the casing and the housing for discharging into the housing contaminant matter in fluid introduced into the casing and separated centrifugally therefrom within the casing;

h. seal means cooperating between the housing and shaft for sealing against flow of fluid along the shaft from the housing chamber; and i. contaminant deflector means carried by the housing adjacent the seal means for deflecting from the vicinity of the seal means contaminant matter delivered to the housing chamber by the orifice means.

39. Apparatus according to claim 38 wherein the deflector means comprises at least one fin-like baffle member extending from the housing into the housing chamber along an arc substantially about the shaft axis adjacent to and radially outwardly of the seal means at least above the seal means, the baffle member having a surface facing away from the shaft axis which slopes away from the shaft axis proceeding into the housing chamber from the housing.

40. Apparatus according to claim 39 wherein said arc extends circumferentially around the seal means.

41. Apparatus according to claim 38 wherein the deflector means comprises at least one groove defined in the housing along an arc substantially about the shaft axis adjacent to and radially outwardly of the seal means at least above the seal means, the groove opening to the housing chambers and having wall surfaces which face away from the shaft axis proceeding along the groove from the bottom thereof to the housing chamber.

42. Apparatus according to claim 41 wherein the deflector means comprises deflector fin means carried by the rotary casing adjacent the opening of the deflector groove to the housing chamber.

43. Apparatus according to claim 41 wherein the arc of said groove extends circumferentially around the seal means.

44. A combination pitot pump and centrifugal separator, including:

a. a housing having a chamber therein;
b. a rotatable shaft extending into the housing chamber;
c. a rotary casing mounted to the shaft in the housing chamber for rotation in a selected direction about an axis;
d. means for delivering to the interior of the casing a contaminated fluid to be pumped and cleaned;
e. a pumped fluid discharge duct coaxial with the casing;
f. a pitot tube extending radially of said axis in the rotary casing and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct;
g. orifice means carried by the outer periphery of the rotary casing and communicating between the interiors of the casing and the housing for discharging into the housing contaminant matter in fluid introduced into the casing and separated centrifugally therefrom within the casing.
h. seal means cooperating between the housing end and the shaft for sealing against flow of fluid along the shaft from the housing chamber; and
i. circulation means for directing a stream of fluid past the seal means for removing from the vicinity of the seal means contaminant matter delivered to the housing chamber by the orifice means.

45. Apparatus according to claim 44 wherein the circulation means comprises at least one circulation passage formed through the rotary casing from an inlet opening to the interior of the casing to an outlet opening to the housing chamber adjacent the seal means, the circulation passage opening to the interior of the casing at a location spaced from the axis for receiving fluid from the casing which is relatively clean of contaminant matter as compared to fluid delivered to the interior of the casing.

46. Apparatus according to claim 44 wherein the circulation means comprises a circulation passage through the housing opening to the housing chamber proximate to and above the shaft adjacent the seal means, and duct means for supplying to the circulation passage a portion of the pumped fluid from said discharge duct.

47. A method of preventing accumulations of heavy contaminant matter on the outer peripheral surfaces of a chamber in a rotary casing in a centrifugal separator which may cause the casing to become unbalanced or which may cause clogging of discharge orifices formed through the outer periphery of the casing, the method comprising the step of preventing during each rotation of the casing the formation of a stagnant or low velocity laminar flow boundary layer along the outer peripheral surfaces of the casing chamber along the entire path of movement of the contaminant discharge orifices.

48. The method according to claim 47 wherein the step of preventing the formation of the boundary layer includes agitating fluid and matter therein principally only in an area proximately adjacent to the chamber outer peripheral surfaces.

49. The method according to claim 48 wherein the agitating step is performed by locating in the chamber a stationary streamlined vane having an end defined of an erosion resistant material and spaced closely adjacent the casing peripheral surface.

50. The method according to claim 48 wherein the agitating step is performed by directing toward said casing peripheral surfaces a stream of agitating fluid at high velocity.

51. The method according to claim 50 including supplying the agitating fluid from a location in the casing chamber spaced toward the axis of rotation thereof from the chamber outer peripheral surface.

52. The method according to claim 51 including collecting the agitating fluid from the chamber and pressurizing the same by means of a pitot tube prior to directing the fluid toward the casing outer peripheral surface.

53. A combination pitot pump and centrifugal separator including:

a. a rotary casing mounted for rotation in a selected direction about an axis and defining therein a chamber;
b. a pumped fluid discharge duct coaxial with the casing;
c. annular baffle means carried by the casing in the chamber and dividing the casing chamber into an inner pumping chamber within the baffle means and its annulus and into an outer pumping chamber;
d. means for delivering to the outer pumping chamber a contaminated fluid to be pumped and cleaned;
e. a pitot tube extending radially of said axis in the annulus of the baffle means and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct; and
f. orifice means carried by the outer periphery of the rotary casing and communicating between the interior and the exterior thereof for discharging from the casing contaminant matter in fluid delivered to the casing and separated centrifugally therefrom within the casing.

54. Apparatus according to claim 53 wherein the baffle means comprises a plurality of annular disks disposed normal to the casing axis and spaced along the axis.

55. In a combination pitot pump and centrifugal separator, including a rotary casing mounted for rotation in a selected direction about an axis; means for delivering to the interior of the casing a contaminated fluid to be pumped and cleaned; a pumped fluid discharge duct coaxial with the casing; a pitot tube extending radially of said axis in the rotary casing and having adjacent its outer end an inlet facing in a direction opposite to the direction of rotation of the rotary casing, the pitot tube having a passage connected to the inlet and extending generally in the direction of casing rotation and toward the axis to an outlet connected to the discharge duct; and orifice means carried by the outer periphery of the rotary casing and communicating between the interior and the exterior of the casing for discharging from the casing contaminant matter in fluid introduced into the casing and separated centrifugally therefrom within the casing; the improvement comprising means fixed in position in the chamber and disposed proximately adjacent the path followed by the orifice means during rotation of the casing for agitating centrifugally separated accumulations of contaminant matter on the inner surface of the casing at the outer periphery thereof during pumping and separating operation of the pump and separator.

56. A centrifugal separator for separating particulate and sludge contaminants from a liquid carrier medium, including a. a rotary casing mounted for rotation about an axis,
b. means for delivering to the casing a liquid medium containing contaminant material and for conducting from the casing liquid medium from which the contaminant material has been removed,
c. orifice means carried by the outer periphery of the casing and communicating between the interior and the exterior thereof for discharging from the casing contaminant matter in liquid introduced into the casing and separated centrifugally therefrom within the casing, and
d. agitating means in the casing mounted for rotation of the casing relatively therepast in operative association with the orifice means inwardly toward the axis of the path of movement of the orifice means during rotation of the casing and operable during separating operation of the separator for agitating centrifugally separated accumulations of contaminant matter on the inner surface of the casing along the path of the orifice means adequately to prevent substantial clogging of the orifice means by the contaminant matter.

57. Apparatus according to claim 56 wherein the agitating means comprises a vane having an agitating end disposed proximate the inner surface of the casing adjacent the path of movement of the orifice means.

58. Apparatus according to claim 57 wherein the orifice means are disposed substantially in a common plane normal to the casing axis, and the agitating end of the vane is disposed substantially in said plane.

59. Apparatus according to claim 57 wherein the vane is fixed in the casing.

60. Apparatus according to claim 57 wherein the vane has a substantially smaller projected area in a plane including the casing axis and passing through the vane than it does in a plane normal to the casing axis.

61. Apparatus according to claim 60 wherein the vane has a terminal portion adjacent the agitating end thereof which is streamlined relative to the flow of fluid therepast in the direction of rotation of the casing.

62. Apparatus according to claim 57 wherein the vane, at least at and adjacent the agitating end thereof, is defined by an erosion resistant material.

63. Apparatus according to claim 62 wherein the erosion resistant material is tungsten carbide.

64. Apparatus according to claim 56 wherein the agitating means comprises jet means for directing a stream of fluid to the inner surfaces of the casing at the outer periphery thereof in the vicinity of the orifice means.

65. Apparatus according to claim 64 wherein the jet means includes jet passage means having an outlet in the interior of the casing directed toward the casing inner surface in said vicinity.

66. Apparatus according to claim 65 including a vane mounted in the casing and extending to an end spaced proximate to the inner surface of the casing in the vicinity of the orifice means, and wherein the jet passage means is defined in the vane so that the jet passage means outlet opens from the end of the vane.

67. Apparatus according to claim 66 wherein the vane is stationary in the casing and extends generally radially of the casing axis.

68. Apparatus according to claim 65 wherein the vane has a substantially smaller projected area in a plane including the casing axis and passing through the vane than it does in a plane normal to the casing axis.

69. Apparatus according to claim 65 wherein the vane, at least at and adjacent the agitating end thereof, is defined by an erosion resistant material.

70. Apparatus according to claim 65 wherein the jet passage means has an inlet defined in the vane toward the casing axis from the outlet thereof and opening into the casing in a direction opposite to the direction of rotation of the casing.

* * * * *

UNITED STATES PATENT AND TRADEMARK OFFICE

CERTIFICATE OF CORRECTION

PATENT NO. : 4,036,427

DATED : July 19, 1977

INVENTOR(S) : John W. Erickson, Vitolis Budrys, Francis Barton Brown

It is certified that error appears in the above-identified patent and that said Letters Patent are hereby corrected as shown below:

| | | | |
|---|---|---|---|
| Column 1, | line | 37 | for "said" read -- sand -- . |
| " 2, | " | 27 | start a new paragraph at "Also". |
| " 4, | " | 31 | for "extend" read -- extent --; |
| " 4, | " | 47 | for "lowemost" read -- lowermost --. |
| " 5, | " | 2 | for "91" read -- discharge --; |
| " 5, | " | 32 | for "radialy" read -- radially --. |
| " 6, | " | 33 | for "moe" read -- move --. |
| " 7, | " | 47 | for "n" read -- in --. |
| " 8, | " | 50 | for "extend" read -- extent --. |
| " 9, | " | 10 | for "stips" read -- strips --; |
| " 9, | " | 35 | for "84" read -- 85 --. |
| " 11, | " | 7 | for "cemtrifugal" read -- centrifugal --. |
| " 14, | " | 2 | After "casing" read -- axis --. |
| " 15, | " | 20 | for "20" read -- 29 --. |

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*